US007034752B2

(12) United States Patent
Sekiguchi et al.

(10) Patent No.: US 7,034,752 B2
(45) Date of Patent: Apr. 25, 2006

(54) SURFACE MOUNT ANTENNA, AND AN ANTENNA ELEMENT MOUNTING METHOD

(75) Inventors: Masami Sekiguchi, Kanagawa (JP); Masayasu Kaneko, Ibaraki (JP)

(73) Assignee: Sony Corporation, (JP)

( * ) Notice: Subject to any disclaimer, the term of this patent is extended or adjusted under 35 U.S.C. 154(b) by 34 days.

(21) Appl. No.: 10/849,801

(22) Filed: May 21, 2004

(65) Prior Publication Data

US 2005/0001768 A1 Jan. 6, 2005

(30) Foreign Application Priority Data

May 29, 2003 (JP) ..... P2003-152443

(51) Int. Cl.
*H01Q 1/38* (2006.01)

(52) U.S. Cl. ..... 343/700 MS; 343/702; 343/846

(58) Field of Classification Search ..... 343/700 MS, 343/702, 795, 846, 849, 873, 895
See application file for complete search history.

(56) References Cited

U.S. PATENT DOCUMENTS

| | | | | |
|---|---|---|---|---|
| 5,510,802 | A * | 4/1996 | Tsuru et al. | 343/700 MS |
| 5,537,123 | A * | 7/1996 | Mandai et al. | 343/700 MS |
| 5,861,854 | A * | 1/1999 | Kawahata et al. | 343/702 |
| 6,177,908 | B1 | 1/2001 | Kawahata et al. | 343/702 |
| 6,639,559 | B1 * | 10/2003 | Okabe et al. | 343/700 MS |

FOREIGN PATENT DOCUMENTS

| | | |
|---|---|---|
| EP | 0 872 912 A2 | 10/1998 |
| EP | 0 982 798 A2 | 3/2000 |
| EP | 1 256 998 A2 | 11/2002 |
| JP | 10-173434 | 6/1998 |
| WO | WO 01/11721 A1 | 2/2001 |

OTHER PUBLICATIONS

EPO Search Report dated Aug. 12, 2004.

* cited by examiner

*Primary Examiner*—Tuyet Vo
*Assistant Examiner*—Jimmy Vu
(74) *Attorney, Agent, or Firm*—Rader, Fishman & Grauer PLLC; Ronald P. Kananen

(57) ABSTRACT

A surface mount antenna is configured by mounting on a board a dielectric material on which electrodes are provided, wherein an antenna element comprises the electrodes having a ground electrode and a feed electrode, and a ground mount pattern connected to the ground electrode of the electrode and a feed mount pattern connected to the feed electrode of the electrode are formed on the board with a predetermined distance in-between. A frequency is adjusted by changing impedance by varying a pattern width of a portion connecting a ground electrode of the electrodes and a GND pattern of a ground side of the board, and an impedance matching is performed by changing capacitance based on dielectric constant of the board by varying area of a surface of a feed pattern at a position where a feed electrode of the electrodes and a feed side of the board are in opposing relation.

6 Claims, 6 Drawing Sheets

SURFACE MOUNT ANTENNA, AND AN ANTENNA ELEMENT MOUNTING METHOD

CROSS REFERENCE TO RELATED APPLICATION

This application claims priority from Japanese Priority Document No. 2003-152443, filed on May 29, 2003 with the Japanese Patent Office, which document is hereby incorporated by reference.

BACKGROUND OF THE INVENTION

1. Field of the Invention

This invention relates to an antenna element mounting method and a surface mount antenna, and more particularly to a surface mount antenna designed to standardize an antenna element to be mounted on a set, and an antenna element mounting method.

2. Description of the Related Art

A surface mount antenna of a conventional technology is such that an antenna has an antenna element formed with electrodes on surfaces of dielectric material or magnetic material. The antenna of this type is designed to perform an impedance matching at a feed section by itself, and to match with a predetermined utilized frequency. For example, see Japanese Laid-Open Patent No. PH10-173434.

However, in the conventional antenna such as described above, the antenna element is adapted to use by mounting on a mount board when this antenna element is assembled in a set. When this antenna element is assembled in a different set, a mount board is also different usually, and a ground GND is also different, so that an impedance matching and a receiving utilized frequency of the antenna element are misaligned when the antenna element is assembled as it is. On this account, the conventional antenna element where the electrodes are formed on the dielectric material or the magnetic material is to be different as per set. Accordingly, in standardizing the mount parts, there is a problem that the antenna element itself is not able to be standardized without drastic improvements.

Accordingly, in an antenna element mounting method and a surface mount antenna realizing the use of a standard antenna element even in the different set, there is a problem to be solved.

SUMMARY OF THE INVENTION

In order to solve the above-mentioned problem, the surface mount antenna and the antenna element mounting method are based on the following configuration. That is, a surface mount antenna is the antenna to be configured by mounting on a mount board an antenna element by forming electrodes on a dielectric material, and the electrodes are formed to have a ground electrode and a feed electrode, wherein both ends of the ground electrode and the feed electrode are directed in an opposed relation to each other, and a ground mount pattern to be connected to the ground electrode and a feed mount pattern to be connected to the feed electrode are formed to have a predetermined distance between them on the mount board. In the above mentioned surface mount antenna, a feed pattern is provided on a backside of the board. Further, in the above mentioned surface mount antenna, the dielectric material is formed to be a rectangular solid shape, and the electrodes are formed to include a right bottom face of the feed electrode, a right side face, a top face, a left side face, and left bottom face of the ground electrode so as to cover surfaces of the rectangular solid shaped dielectric material by the electrodes.

In the antenna element mounting method according to the present invention, when an antenna element formed by forming electrodes on surfaces of a dielectric material is mounted on a board, a utilized frequency is adjusted by changing an impedance by varying a pattern width of a portion connecting a ground electrode of the above mentioned electrodes and a GND pattern of a ground side of the board, and an impedance matching is performed by changing a capacitance based on a dielectric constant of the board by varying an area of a surface of a feed pattern at a position of a feed side of the board in opposing relation to a feed electrode of the above mentioned electrodes. In the above mentioned antenna element mounting method, the feed pattern is provided on a backside of the board. In the above mentioned antenna element mounting method, the dielectric material is formed to be a rectangular solid shape, and the electrodes are formed to include a right bottom face of the feed electrode, a right side face, a top face, a left side face, and left bottom face of the ground electrode so as to cover surfaces of the rectangular solid shaped dielectric material by the electrodes.

According to the present invention as described above, a utilized frequency is adjusted by changing an impedance by varying a pattern width of a portion connecting a ground electrode of the above mentioned electrodes and a GND pattern of a ground side of the board, and an impedance matching is performed by changing a capacitance based on a dielectric constant of the board by varying area of a surface of a feed pattern at a position of a feed side of the board in opposing relation to a feed electrode of the above mentioned electrodes while the shapes of the dielectric material and the electrodes configuring the antenna element are left unchanged. Therefore, it becomes possible to adjust a predetermined utilized frequency and to perform an impedance matching by changing the GND pattern side and the feed pattern side without changing the shape of the antenna element. This means that it is possible to standardize the antenna element by using the common antenna element, even though the board side of the set may have a change or an external factor.

DETAILED DESCRIPTION OF THE PREFERRED EMBODIMENTS

Figure 1:
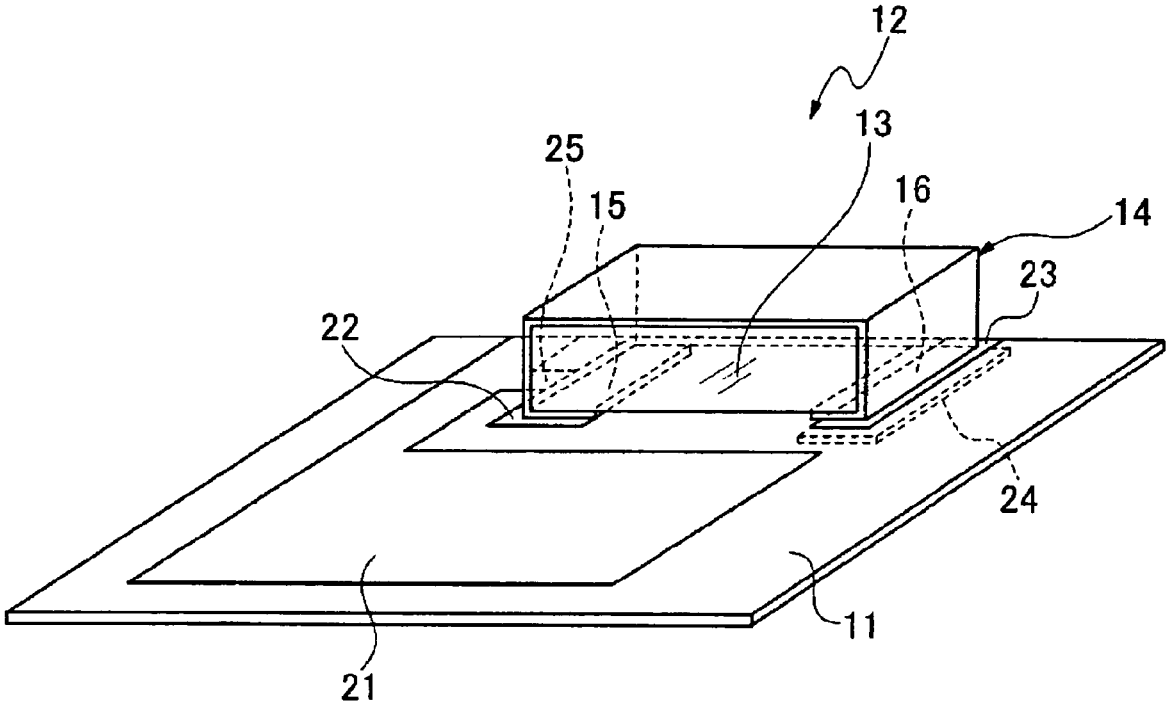
FIG. 1 is a perspective view showing a condition where an antenna element of a surface mount antenna of the present invention is mounted on a board.

Now, embodiments of a surface mount antenna and an antenna element mounting method according to the present invention are described with reference to the accompanying drawings. In a surface mount antenna capable of specifying the antenna element mounting method of the present invention, an antenna element 12 is mounted on a part of a surface of a board 11 as shown in FIG. 1, and this surface mount antenna's utilized frequency is adjusted by adjusting a pattern width of a ground pattern 25 connected to a GND pattern 21 which is connected to a ground electrode 15 of the antenna element 12, and an impedance matching is carried out by adjusting a positional relation of a feed pattern located in opposed relation to a feed mount pattern 23 of the feed side connected to a feed electrode 16.

Figure 2:
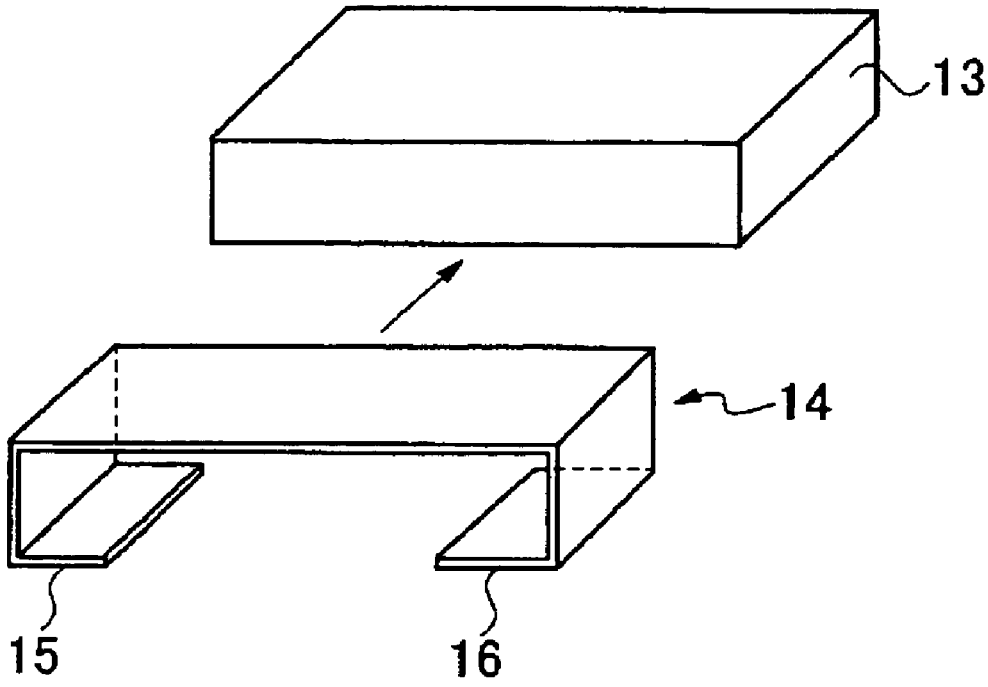
FIG. 2 is a schematic perspective view showing relations between a dielectric material and electrodes configuring the antenna element of the surface mount antenna.
Figure 3:
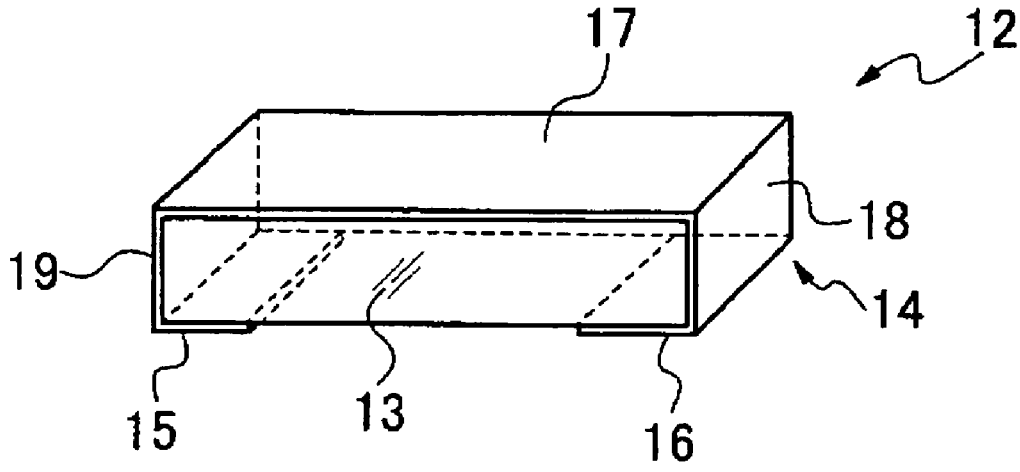
FIG. 3 is an exterior view of the antenna element of the surface mount antenna.

The antenna element 12 is formed as to cover surfaces of a dielectric material 13 formed with a rectangular solid shaped ceramics or the like by a metal electrode 14 as shown in FIG. 2 and FIG. 3. The size of this antenna element 12 is decided roughly depending on a relative permittivity of the dielectric material 13, and the utilized frequency. For example, suppose the relative permittivity is 20, and the utilized frequency is 2.4 GHz, then the size of the antenna element 12 becomes around 10 mm×4 mm×2 mm in length, width, and height.

In the electrode 14, both ends of a rectangular shaped plate-Like metal member are bent so as to be opposed to each other, and are formed to have a predetermined distance between them, thereby the electrode 14 is so configured that one of the ends becomes the ground electrode 15 to be connected to the ground side, and the other end becomes the feed electrode 16 to be connected to the feed side. In this embodiment, the electrode 14 has a shape consistent with the shape of the rectangular solid shaped dielectric material 13, and comprises of a top face 17 made from a rectangular shaped plate-like metal member having a width of the dielectric material 13 for covering the top face of the rectangular solid shaped dielectric material 13, a right side face 18 formed by folding one edge of the plate-like metal member perpendicularly to the top face 17 for covering a right side face of the dielectric material 13, a left side face 19 formed by folding the other edge of the plate-like metal member perpendicularly to the top face 17 for covering a left side face of the dielectric material 13, the feed electrode 16 to be a right bottom face by folding inside the plate-like metal member perpendicularly to the right side face 18 for covering a part of bottom face of the dielectric material 13, and the ground electrode 15 to be a left bottom face by folding inside the plate-like metal member perpendicularly to the left side face 19 for covering a part of bottom face of the dielectric material 13. This electrode 14 is a symmetrical shape, and when this electrode 14 is mounted on the board 11, it is possible to mount this electrode 14 with disregard to a direction of thereof. Depending on how to assemble, the left side becomes the ground electrode 15 of the ground side and the right side becomes the feed electrode 16 of the feed side in FIG. 3.

Figure 4:
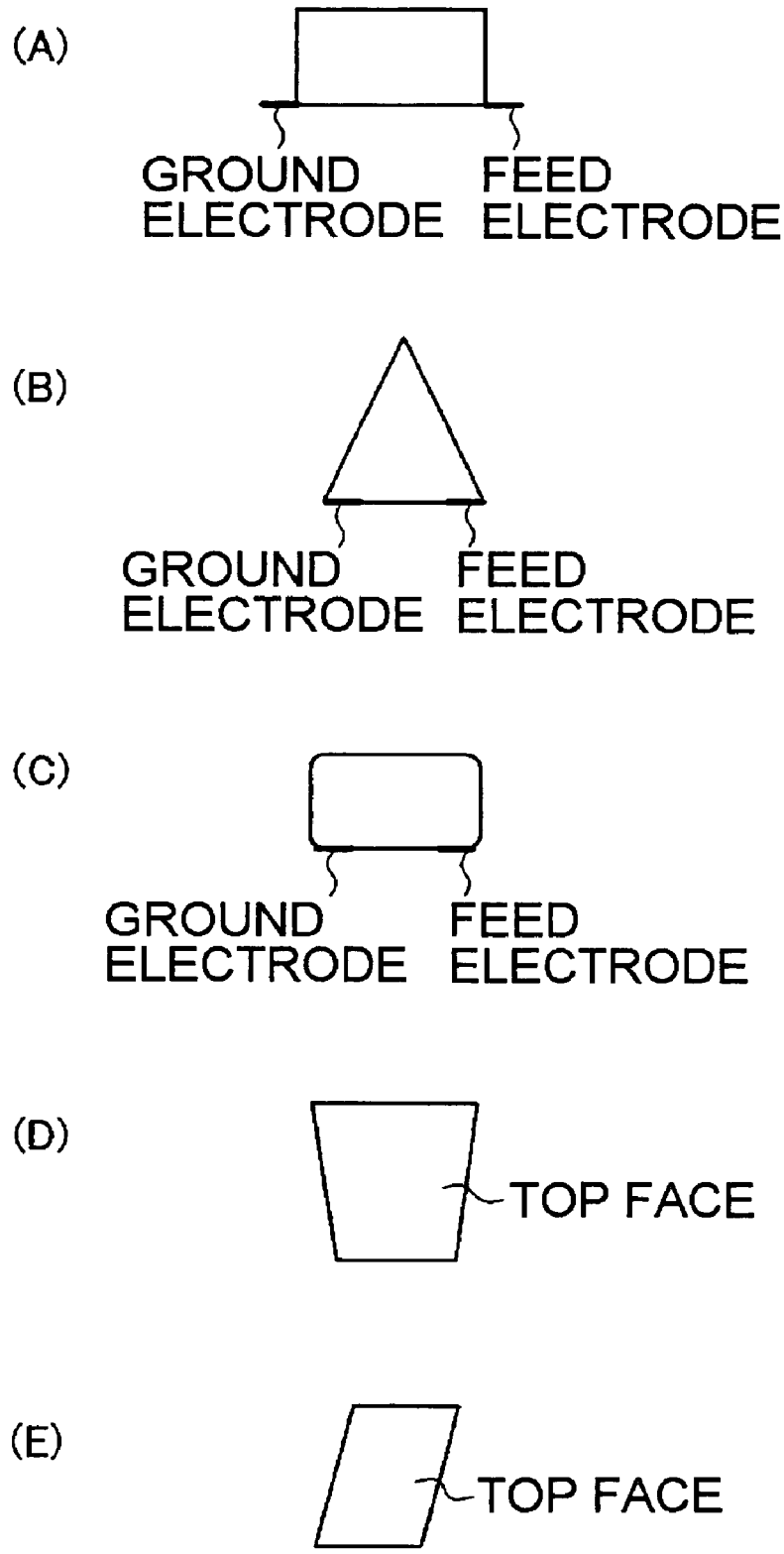
FIG. 4 consisting of FIG. 4A to 4F, is a diagram for describing a modified example of the shapes of the electrodes for the surface mount antenna.

As a shape of such electrode 14, there are various shapes to be employed. That is, the shape only requires to be such a shape matching with the shape of the dielectric material 13 and being able to be mounted on the board 11, and they may be one where a ground electrode and a feed electrode are folded outside as shown in FIG. 4(A), one where it is shaped in a triangle shape, and a ground electrode and a feed electrode are folded inside as shown in FIG. 4(B), and one where it is shaped in an elliptical shape, and a ground electrode and a feed electrode are folded inside as shown in FIG. 4(C). The shape is not limited to these shaped disclosed in FIG. 4.

Further, the shape of the electrode 14 is not limited to a rectangular shape when viewed from above. For example, the top face of the electrode 14 may be a trapezoidal shape as shown in FIG. 4(D), or may be a shape of parallelogram as shown in FIG. 4(E). However, the shape is not limited to these shapes.

In the present embodiment, the antenna element 12 has a rectangular solid shape, and the antenna element 12 is mounted on the board 11 as shown in FIG. 1. The board 11 includes a ground mount pattern 22 of the ground side mounted on the GND pattern 21 in a connected state, the feed mount pattern 23 of the feed side at a position apart from the ground mount pattern 22 by a predetermined distance, or at a position of a distance between the ground pattern electrode 15 and the feed electrode 16, and a feed pattern 24 at the backside of the feed mount pattern 23.

Figure 5:
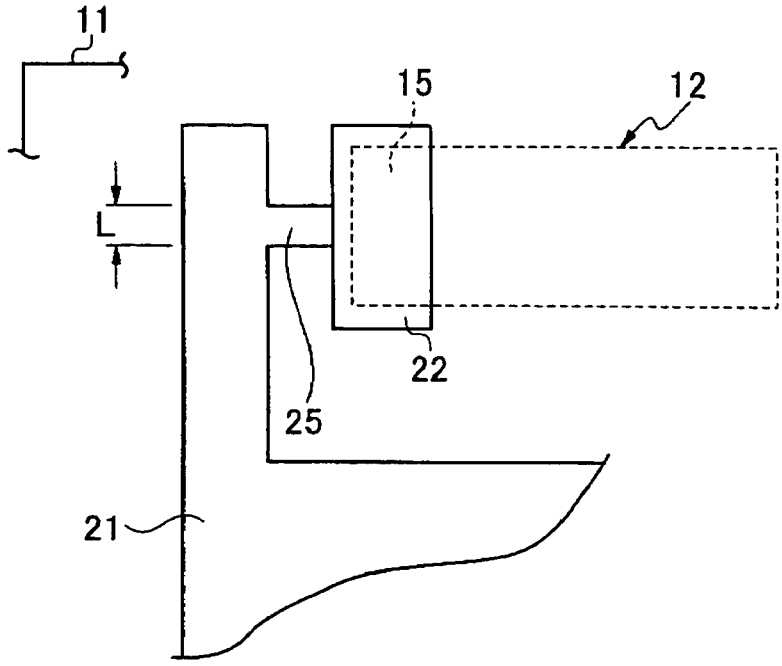
FIG. 5 is a diagram for describing a connection state connecting a GND pattern of the ground side and a ground electrode of the antenna element.

In the ground side, a mounting processing of the antenna element 12 on the board 11 is carried out by providing the ground mount pattern 22 at a surface side of the board 11 to which the antenna element 12 is mounted, and by connecting the ground mount pattern 22 to the GND pattern 21 by way of the ground pattern 25 having a certain pattern width L as shown in FIG. 5. The utilized frequency is adjusted by changing the pattern width L of the ground pattern 25 so as to adjust the inductance.

Figure 6:
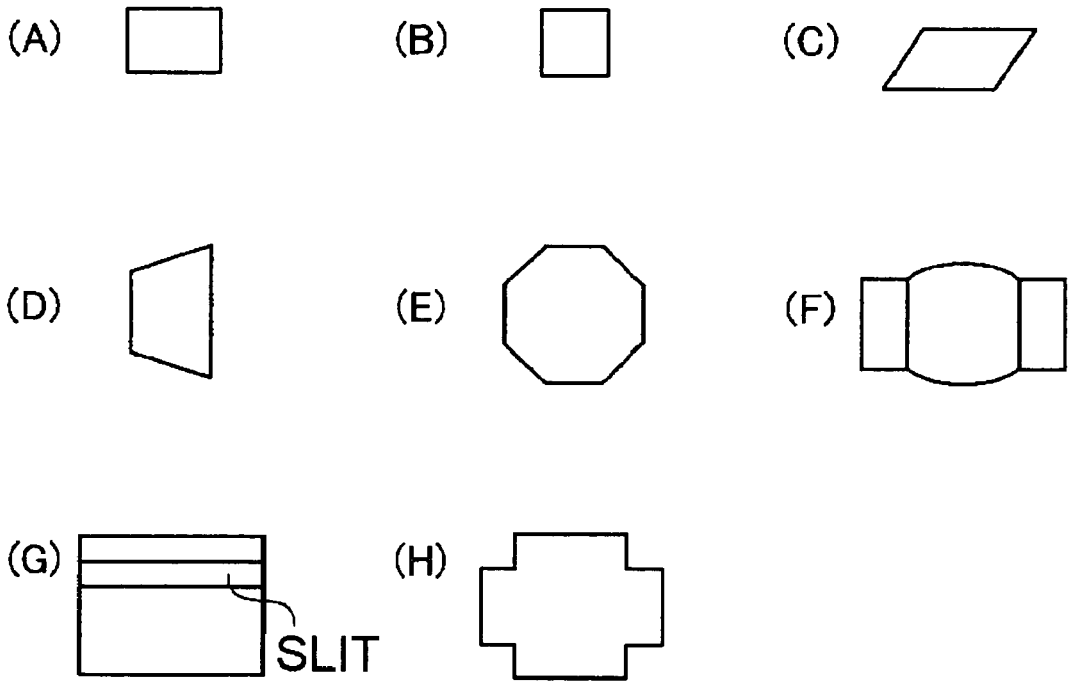
FIG. 6 consisting of FIG. 6A to 6H, is a diagram for describing a modified example of the ground pattern shape for the surface mount antenna.

The ground pattern 25 is for adjusting the inductance, so the shape of the ground pattern 25 is thought to have various shapes without limiting to the rectangular shape. For example, the shape of the ground pattern 25 may be a rectangular shape same as the present embodiment as shown in FIG. 6(A), a square shape as shown in FIG. 6(B), a rhombic shape as shown in FIG. 6(C), a trapezoidal shape as shown in FIG. 6(D), a polygonal shape as shown in FIG. 6(E), a circular shape as shown in FIG. 6(F), a shape having a slit inside as shown in FIG. 6(G), a shape having cutouts at corners as shown in FIG. 6(H), or the like. However, the shape is not limited to these shapes.

Figure 7:
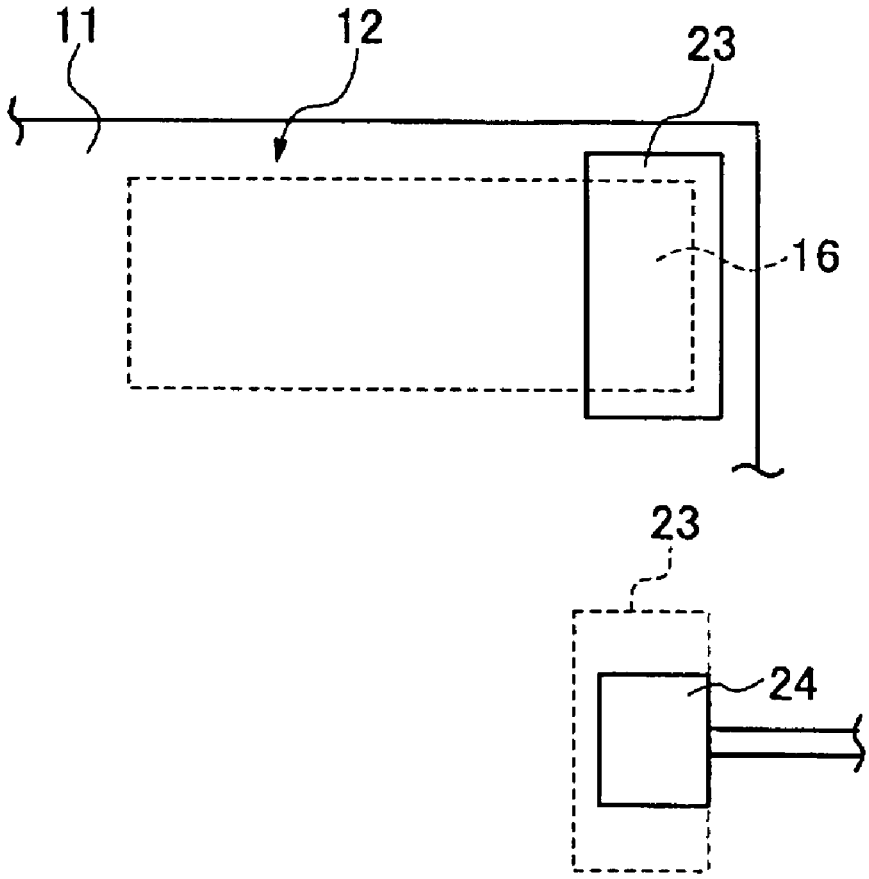
FIG. 7 is a diagram for describing relations between a feed electrode and a feed pattern of the feed side.

In the feed side, the feed mount pattern 23 is provided on the surface side of the board 11 to which the antenna element 12 is mounted as shown in FIG. 7, and the feed pattern 24 is provided at a back side and at a position opposing to the feed mount pattern 23. Depending on an relative permittivity of the board 11, a coupling capacitance between the feed mount pattern 23 and the feed pattern 24 of the feed side is altered by changing an area of a face opposing to the feed pattern 24, so that the impedance matching is carried out in this way.

Figure 8:
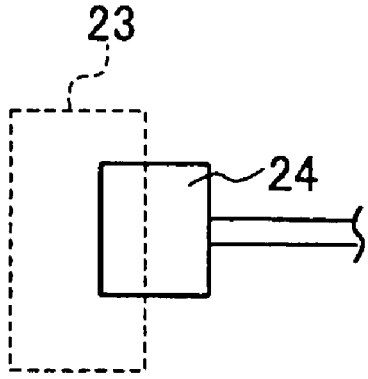
FIG. 8 is a diagram for describing a modified example of the feed pattern shape for the surface mount antenna.

In this case, the feed mount pattern 23 and the feed pattern 24 of the feed side may not always be perfectly opposed to each other at both sides of the board 11, because it is enough to obtain a desired capacitance. For example, the desired capacitance may be obtained by adjusting the dislocation of the feed pattern 24 relative to the feed mount pattern 23 as shown in FIG. 8. Accordingly, this makes the adjustment easy by obtaining a desirable capacitance in a state where dimensional accuracy is relatively rough as the sizes of the both are considered in advance.

Figure 9:
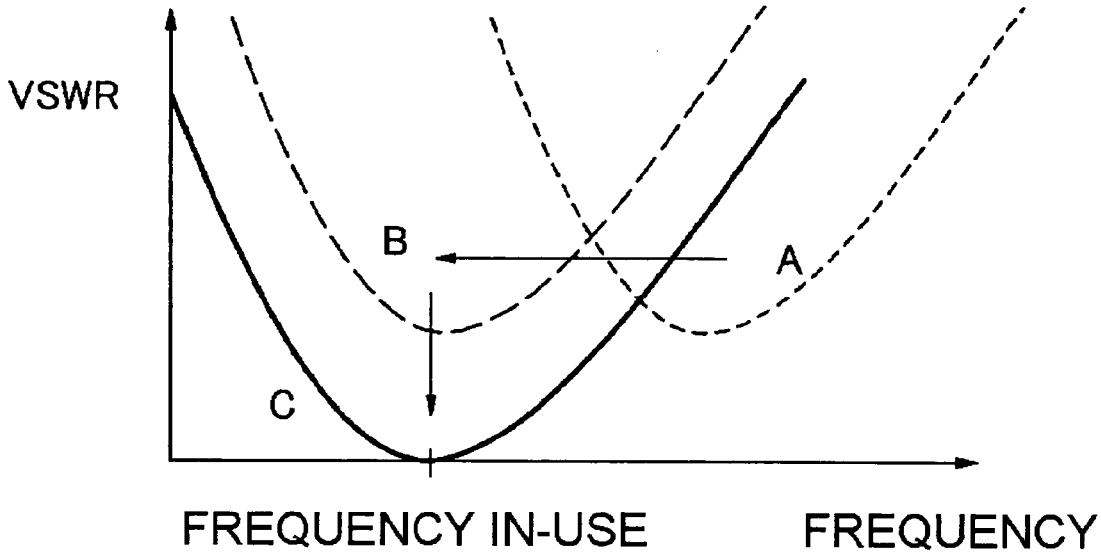
FIG. 9 is a graph designating a procedure for adjusting a utilized frequency and for performing an impedance matching.

Now, a method for adjusting the utilized frequency and the impedance matching is described here with reference to FIG. 9. If the VSWR characteristic obtained at the beginning is "A", then the impedance matching is carried out by lowering the frequency because a target characteristic is "C".

When the frequency is lowered from "A" to "B" in FIG. 9, the inductance value may be increased by narrowing a pattern width L (FIG. 5) of the ground pattern 25 of the ground side. The frequency is determined by $f=1/(2\pi\sqrt{LC})$, and when the L increases, the frequency is lowered, so the pattern width L may be changed to adjust until the frequency becomes the utilized frequency.

Next, in case of carrying out the impedance matching, by changing an area of the face in the feed pattern 24 (FIG. 7) opposing to the feed mount pattern 23 of the feed side, the impedance matching is performed by changing a capacitance. It is different depending on a situation to determine to which direction the capacitance is changed, so if it is no good when the feed pattern 24 is made smaller, then the feed pattern 24 may be made larger.

There is a case where the frequency is displaced a bit as the capacitance changes, but the displacement in frequency is within an allowable range. If the frequency is changed largely, it is possible to arrive close to a target frequency by alternately carrying out the above-mentioned frequency adjustment and the impedance matching.

Conventionally, if the antenna element 12 is mounted on a respective set it is necessary to carry out the adjustment of frequency and the impedance matching as per respective set due to the difference in the state of the GND and the radiation load by a cabinet around the antenna element 12 as per set. Accordingly, in each of the conventional mount antennas, it is necessary to adjust the frequency by changing the length of the electrode and to carry out the impedance matching by providing a radiation electrode to the antenna element.

According to the present invention, the board 11 for mounting the antenna element 12 is manufactured as per respective set, so it is possible to use the standardized antenna element 12, and to determine the utilized frequency by designing the pattern width (ground pattern 25) between the ground mount pattern 22 and the GND pattern 21 of the ground side on the mount board. Further, it is possible to perform the impedance matching by designing the size of the feed mount pattern 23 and the feed pattern 24 of the feed side. Thus, according to the present invention, it is possible to perform the adjustment of frequency and the impedance matching with the board pattern of a respective set by using one type of the antenna element 12, so it becomes possible to standardize the antenna element where the adjustment becomes easy and the antenna element 12 is able to mount a different set as an assembling part.

What is claimed is:

1. A surface mount antenna configured by mounting on a board a dielectric material on which electrodes are provided, characterized in that:

said electrodes are formed to have a ground electrode and a feed electrode; and a ground mount pattern connected to the ground electrode of said electrodes and a feed mount pattern connected to the feed electrode of said electrodes are formed on said board with a predetermined distance between them; wherein a utilized frequency is adjusted by changing an impedance by varying a pattern width of a portion connecting the ground electrode of the electrodes and a GND pattern of a ground side of the board; and an impedance matching is performed by changing a capacitance based on a dielectric constant of the board by varying an area of a surface of a feed pattern at a position where the feed electrode of the electrodes and a feed side of the board are in opposing relation to each other.

2. The surface mount antenna as cited in claim 1, wherein:

said feed pattern is provided at a backside of the board.

3. The surface mount antenna as cited in claim 1, wherein:

said dielectric material is formed to be a rectangular solid shape; and said electrodes are formed to include a right bottom face, a right side face of the feed electrode, a top face, a left side face, and left bottom face of the ground electrode so as to cover surfaces of the rectangular solid shaped dielectric material by said electrode.

4. An antenna element mounting method, when an antenna element formed by forming electrodes on surfaces of a dielectric material is mounted on a board, comprising the steps of:

adjusting a utilized frequency by changing an impedance by varying a pattern width of a portion connecting a ground electrode of said electrodes and a GND pattern of a ground side of the board; and performing an impedance matching by changing a capacitance based on a dielectric constant of the board by varying an area of a surface of a feed pattern at a position where a feed electrode of the electrodes and a feed side of the board are in opposing relation to each other.

5. The antenna element mounting method as cited in claim 4, wherein:

said feed pattern is provided at a backside of the board.

6. The antenna element mounting method as cited in claim 4, wherein:

said dielectric material is formed to be a rectangular solid shape; and said electrodes are formed to include a right bottom face of the feed electrode, a right side face, a top face, a left side face, and left bottom face of the ground electrode so as to cover surfaces of the rectangular solid shaped dielectric material by said electrodes.

* * * * *